US011795654B1

(12) United States Patent
Gilliam, III et al.

(10) Patent No.: US 11,795,654 B1
(45) Date of Patent: Oct. 24, 2023

(54) UNDERPINNING DEVICE WITH PRESSURIZED GROUT ANCHOR SYSTEM

(71) Applicants: Julius C. Gilliam, III, Tampa, FL (US); Ahmed Said, Land O' Lakes, FL (US)

(72) Inventors: Julius C. Gilliam, III, Tampa, FL (US); Ahmed Said, Land O' Lakes, FL (US)

( * ) Notice: Subject to any disclaimer, the term of this patent is extended or adjusted under 35 U.S.C. 154(b) by 295 days.

(21) Appl. No.: 16/740,037

(22) Filed: Jan. 10, 2020

(51) Int. Cl.
*E02D 27/50* (2006.01)
*E02D 35/00* (2006.01)

(52) U.S. Cl.
CPC ..... *E02D 27/50* (2013.01); *E02D 35/00* (2013.01); *E02D 2600/30* (2013.01)

(58) Field of Classification Search
CPC ..... E02D 27/50; E02D 35/00; E02D 2600/30; E02D 5/56; E02D 5/54; E02D 5/801; E02D 5/80; E02D 7/22; E02D 27/12
USPC ... 52/155–166, 677–689, 698–707, 712–715
See application file for complete search history.

(56) References Cited

U.S. PATENT DOCUMENTS 361,927 A * 4/1887 Cartwright ..... B66C 1/666 294/89
3,243,962 A * 4/1966 Ratliff ..... E02D 3/12 405/269
3,354,657 A * 11/1967 Turzillo ..... E02D 5/62 52/153
5,494,378 A * 2/1996 Hanson ..... E02D 5/54 405/234
5,975,808 A * 11/1999 Fujita ..... E02D 5/523 405/253
6,368,021 B1 * 4/2002 Strong ..... E21B 7/20 405/253
7,736,095 B2 * 6/2010 Fujita ..... E02D 5/805 405/253
8,851,801 B2 * 10/2014 Barrett ..... E02D 3/12 405/259.1
D751,369 S * 3/2016 Baldoni ..... D8/380
2005/0141969 A1 * 6/2005 Gregory ..... E02D 27/50 405/241
2007/0214735 A1 * 9/2007 Fujita ..... E02D 5/805 52/157
2016/0186403 A1 * 6/2016 Tomchesson ..... E02D 5/54 405/252.1

(Continued)

FOREIGN PATENT DOCUMENTS

CA 3000932 A1 * 10/2018 ..... E02D 5/801

*Primary Examiner* — Brian D Mattei
*Assistant Examiner* — Omar F Hijaz
(74) *Attorney, Agent, or Firm* — Nicholas Pfeifer; Smith & Hopen, P. A.

(57) ABSTRACT

An underpinning device for support a structure is provided. The underpinning device is anchored within the ground using a grout or cement. The underpinning device comprises a rod having a proximal rod end and a distal rod end. A first interacting element is coupled to the proximal rod end and is encased in the slab of a building. A second interacting element is coupled to the distal rod end and include a removable tip. Upon insertion into the ground, the tip dissociates from the second interacting element creating an opening at the distal rod end. A fluid, such as grout and/or cement is injected into the pipe and extruded through channels within the rod. The fluid is then allowed to cure thereby anchoring the underpinning device within the ground.

15 Claims, 13 Drawing Sheets

(56) References Cited

U.S. PATENT DOCUMENTS

2017/0159256 A1* 6/2017 Li ..... E02D 5/24

* cited by examiner

UNDERPINNING DEVICE WITH PRESSURIZED GROUT ANCHOR SYSTEM

BACKGROUND OF THE INVENTION

1. Field of the Invention

This invention relates, generally, to underpinning devices. More specifically, it relates to underpinning support devices using a pressurized grout anchor system.

2. Brief Description of the Prior Art

Underpinning is routinely used to strengthen the foundation of an existing building or structure for a number of reasons, such as the original foundation becoming unstable, the soil properties changing over time, the soil properties being previously misrepresented, increase load capacity, or natural events having caused a shift in the ground that requires stabilization. Regardless of the reason that underpinning is required, there are several ways in which the underpinning process may be accomplished.

Mass concrete underpinning strengthens the existing foundation by excavating underneath an existing foundation and subsequently pouring concrete. This method is typically performed when the foundation is shallow, and the depth does not exceed 50 feet. The beam and base method is another method that utilizes a concrete beam to redistribute the load and are placed in strategic positions. However, before this method can be implemented, the construction of the beams must be carefully decided based on the architecture of the structure built upon the foundation and corresponding load.

In yet another method, a contractor drives piles at equally spaced distances connected. These piles are connected to one another by concrete or steel needles that penetrate through the walls. However, each of these method, and other existing methods for underpinning a structure require time consumer and specific calculations. Additionally, the composition of the soil and weight of the building must be considered leading to inefficiencies and cost increasing measures during the underpinning process.

Accordingly, what is needed is an underpinning system that is capable of being used in a variety of different soil types, scenarios, and weight loads that is easy to install, safe, cost effective, and practical. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a novel device for providing support to a structure is now met by a new, useful, and nonobvious invention.

The novel invention includes an underpinning device for supporting a structure. The underpinning device comprises a rod having a proximal rod end, a distal rod end, and a rod body extending between the proximal and the distal rod ends. In an embodiment, the rod may be a tubular member or pipe having any number of cross-sectional geometries, such as circular, square, or triangular. Each of the proximal and the distal rod ends define an opening. A plurality of tabs are disposed about a circumference of the rod. Each tab includes a first tab end formed integrally with the rod body and a terminal second tab end spaced apart from the rod body, thereby forming a channel between the cavity and an environment external to the rod. The channel allows for a pressurized fluid to pass through the channel from the cavity to the environment external to the rod.

A first interacting element includes a platform having a first platform surface, a second platform surface, and a platform body extending between the first and the second platform surfaces. Extending away from the first platform surface, an alignment protrusion receives a link within an alignment aperture. The alignment aperture is formed between a first alignment end and a second alignment end of the alignment protrusion.

Extending away from the second platform surface, a first adapter includes a socket formed within a portion of the first adapter. The socket receives the proximal rod end, thereby securing the first interacting element to the rod. In an embodiment, a first set of threads is provided within the socket configured to threadedly engage with a second set of threads as a means for securing the first interacting element to the proximal rod end. In yet another embodiment, the first interacting element is secured to the proximal rod end using a tang and locking strip mechanism.

A second interacting element includes a second adapter having a first adapter end, a second adapter end, and an adapter body encasing a bore. In an embodiment, the first end of the second adapter includes a third set of threads configured to threadedly engage with a fourth set of threads of the distal rod end. Engagement of the third set of threads with the fourth set of threads secures the second interacting element to the distal rod end.

The adapter body extends from the first adapter end to the second adapter end with each adapter end defining an opening. Extending outwardly from at least a portion of an outer surface of the adapter body, a blade is configured to drill a hole within the ground upon rotation of the underpinning device. The second interacting element rotates about a central longitudinal axis extending through the proximal rod end and the distal rod end. To facilitate the drilling of the hole within the ground, the blade may include a first blade portion abutting the outer surface of the body and a second blade portion having a tapered end forming a cutting edge. In an embodiment, the tapered end may be angled away from the body of the blade.

A removable tip is configured to be disposed within the bore of the second adapter and includes a locking mechanism configured to couple the tip within the bore of the second adapter. In an embodiment, the locking mechanism is a flange extending away from a portion of the tip and a locking channel formed within the adapter body, such that when in the locked configuration the tip is disposed fully within the locking channel and when in the unlocked configuration the tip is disposed away from the locking channel.

Upon rotating the underpinning device about the central longitudinal axis in a first direction, the underpinning device is driven into the ground and the flange is transitioned within the locking channel from a first position to a second position, thereby securing the tip at least partially within the bore. Upon rotating the underpinning device about the central longitudinal axis in a second direction, the tip is uncoupled from the second adapter by transitioning the flange within the locking channel from the second position to the first position, thereby uncoupling the tip from the second end of the second adapter.

These and other important links, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

Figure 1:
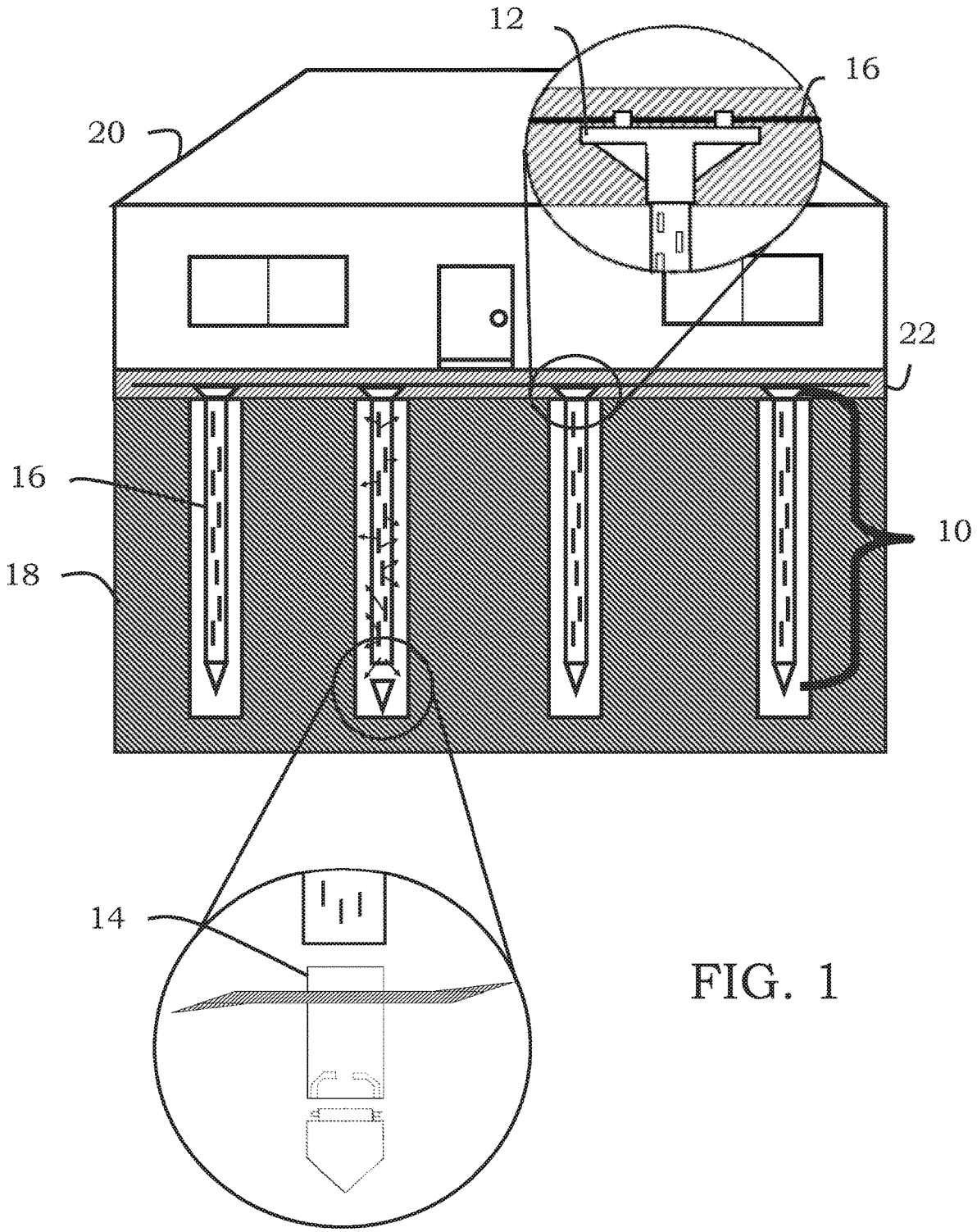
FIG. 1 depicts an in-use view showing a plurality of underpinning devices anchored within the ground and supporting a structure.

The present invention includes an underpinning device for supporting a structure. The underpinning device is drilled into the ground and anchored using a pressurized fluid that is allowed to cure. As shown in FIG. 1, the underpinning device 10 includes first interacting element 12 and second interacting element 14 coupled to rod 16. Underpinning devices 10 are secured within ground 18 to support structure 20 built upon foundation 22. Each underpinning device 10 is coupled to the next underpinning device 10 using one or more links 24. Links 24 may be uncoated rebar, galvanized steel rebar, stainless steel rebar, epoxy-coated rebar, or any other linking device or material known to tie one or more underpinning device 10 to the next in series. First interacting element is encased within foundation 22 to prevent movement of underpinning device 10 and to provide support for structure 20.

Figure 2:
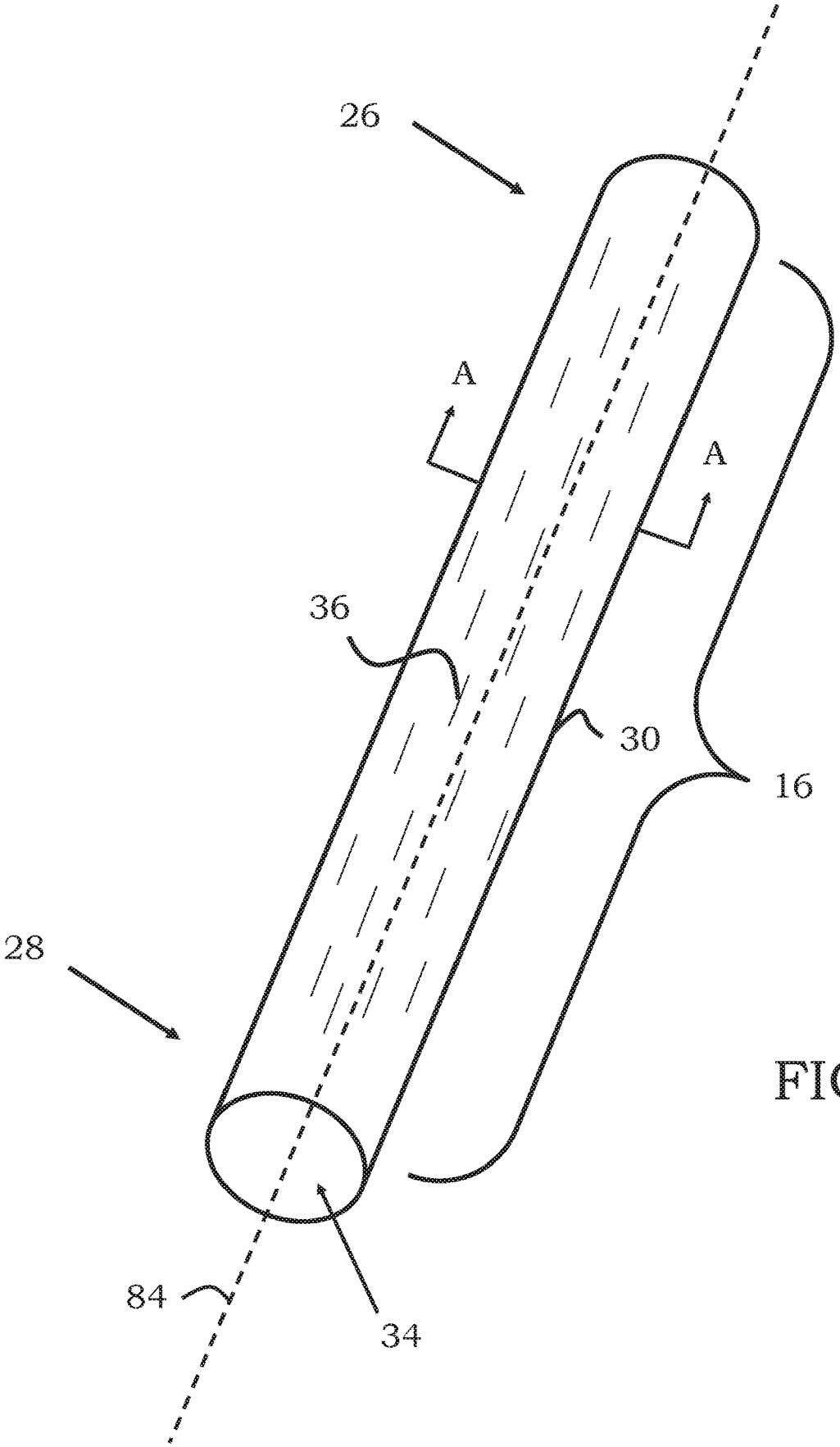
FIG. 2 depicts a perspective view of the rod.

As shown in FIG. 2, rod 16 includes proximal rod end 26, distal rod end 28, and rod body 30 defining cavity 32. Opening 34 is defined by each of the proximal 26 and distal 28 rod ends. Rod 16 may be formed from iron, steel, acrylonitrile-butadiene-styrene (ABS), nylon, polyvinylchloride (PVC), aluminum, brass, bronze, lead, nickel, steel, stainless steel, galvanized steel, carbon steel, titanium, wood, carbon fiber, or other suitable material. Further, rod 16 may have any number of cross-sectional geometries such as circular, triangular, square, or similar geometric shapes.

Figure 3:
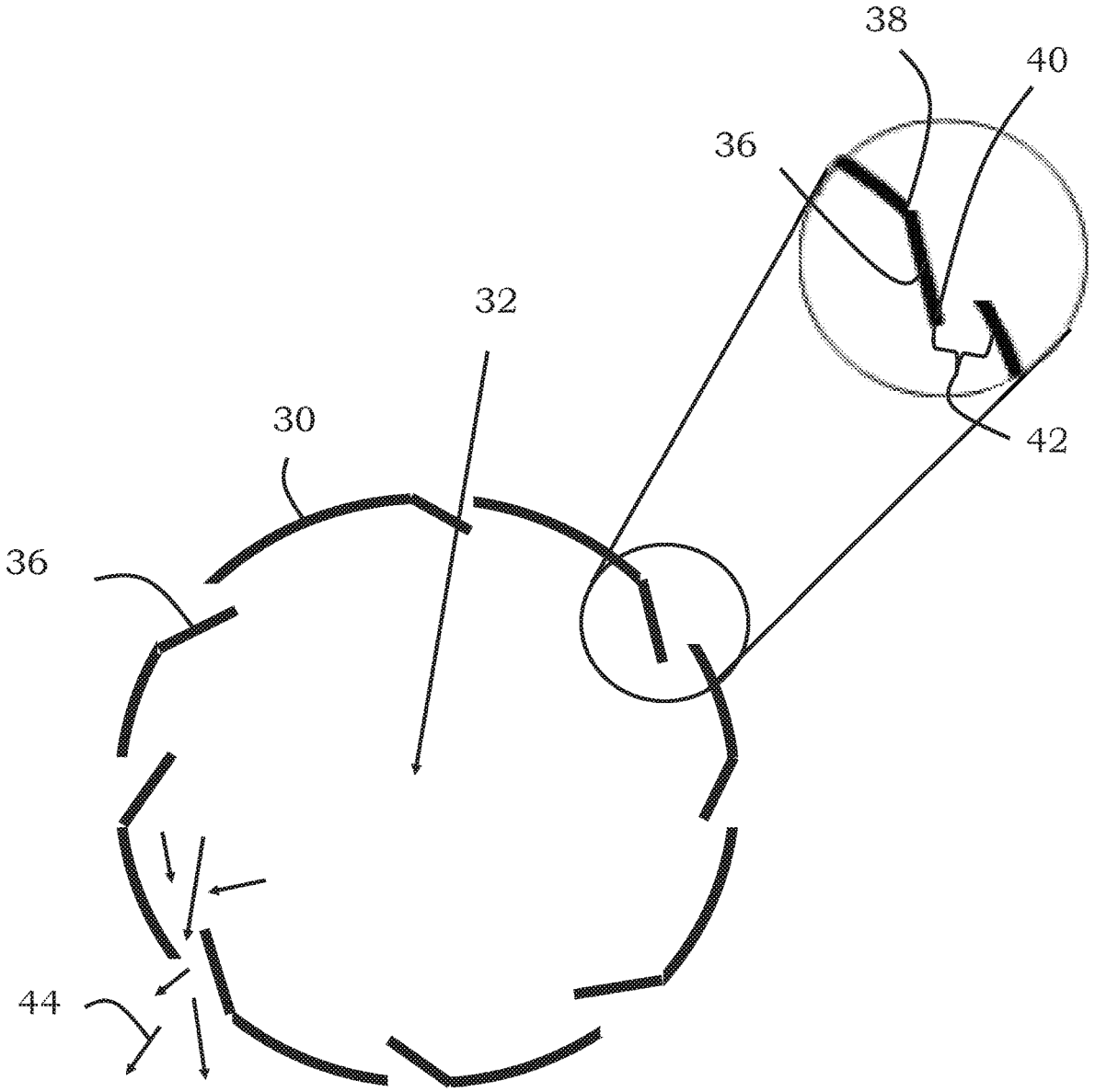
FIG. 3 depicts a cross-sectional view of the rod taken along line A-A of FIG. 2.
Figure 4A:
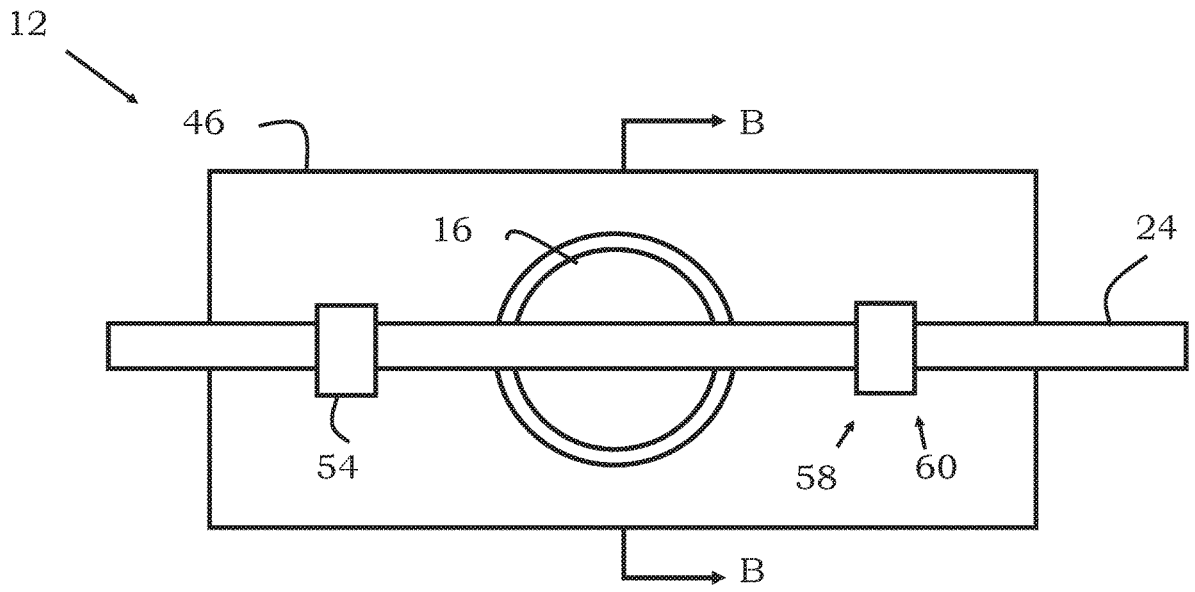
FIG. 4A depicts a top view of the underpinning support with a link disposed through the alignment protrusions.
Figure 4B:
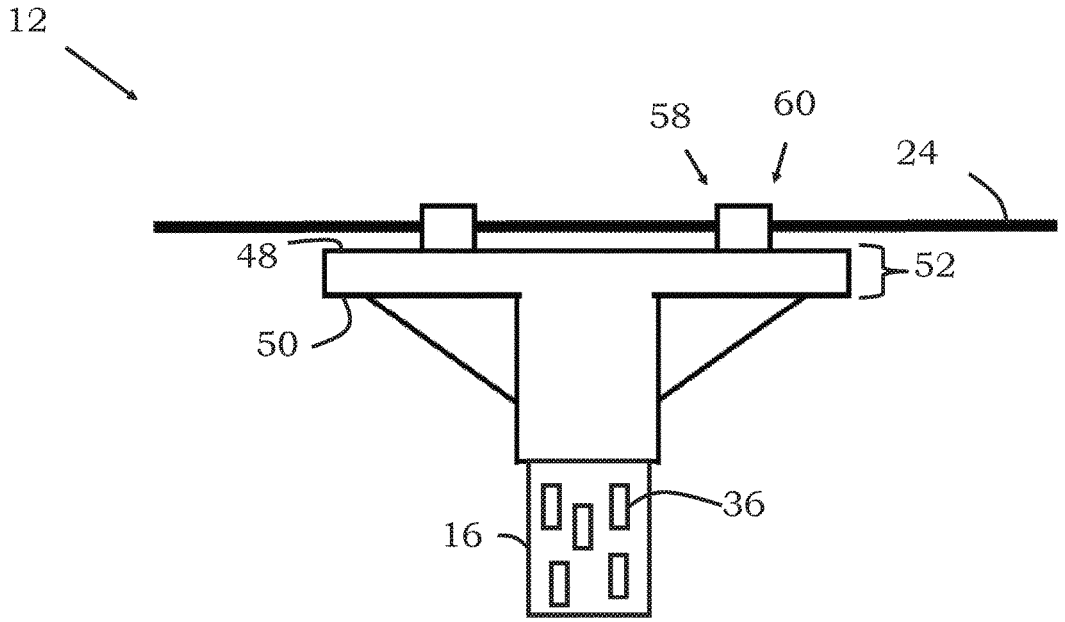
FIG. 4B depicts a side view of the underpinning support with a link disposed thro the alignment protrusions.
Figure 4C:
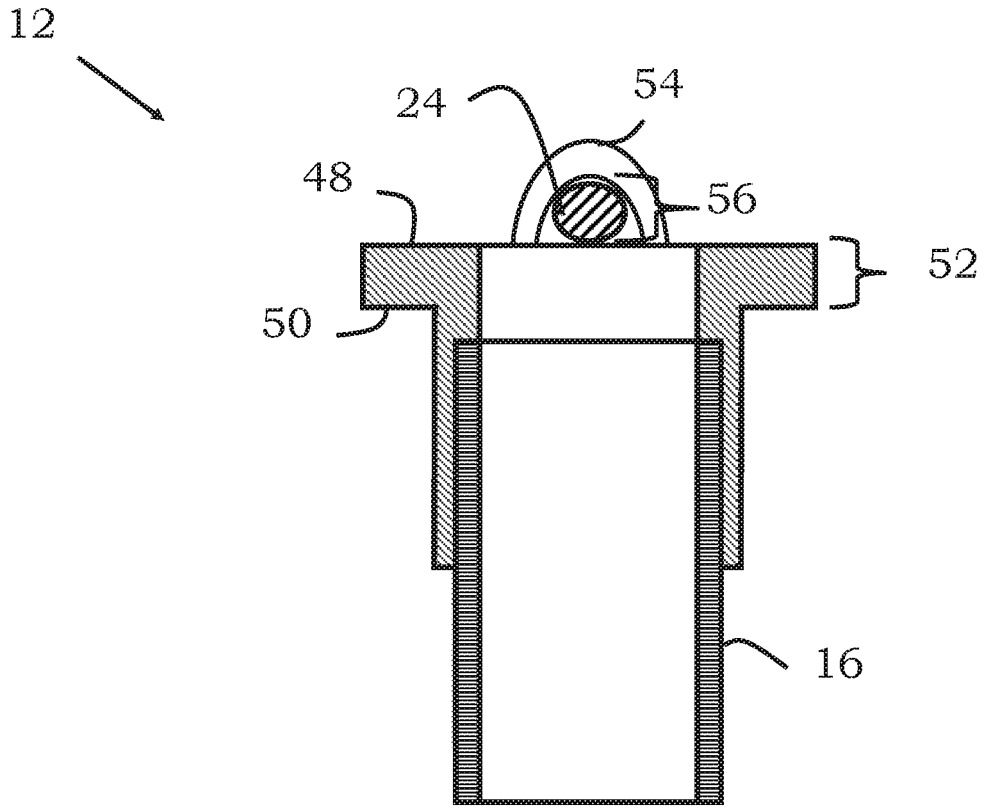
FIG. 4C depicts a cut-away view taken along line B-B in FIG. 4A.
Figure 4D:
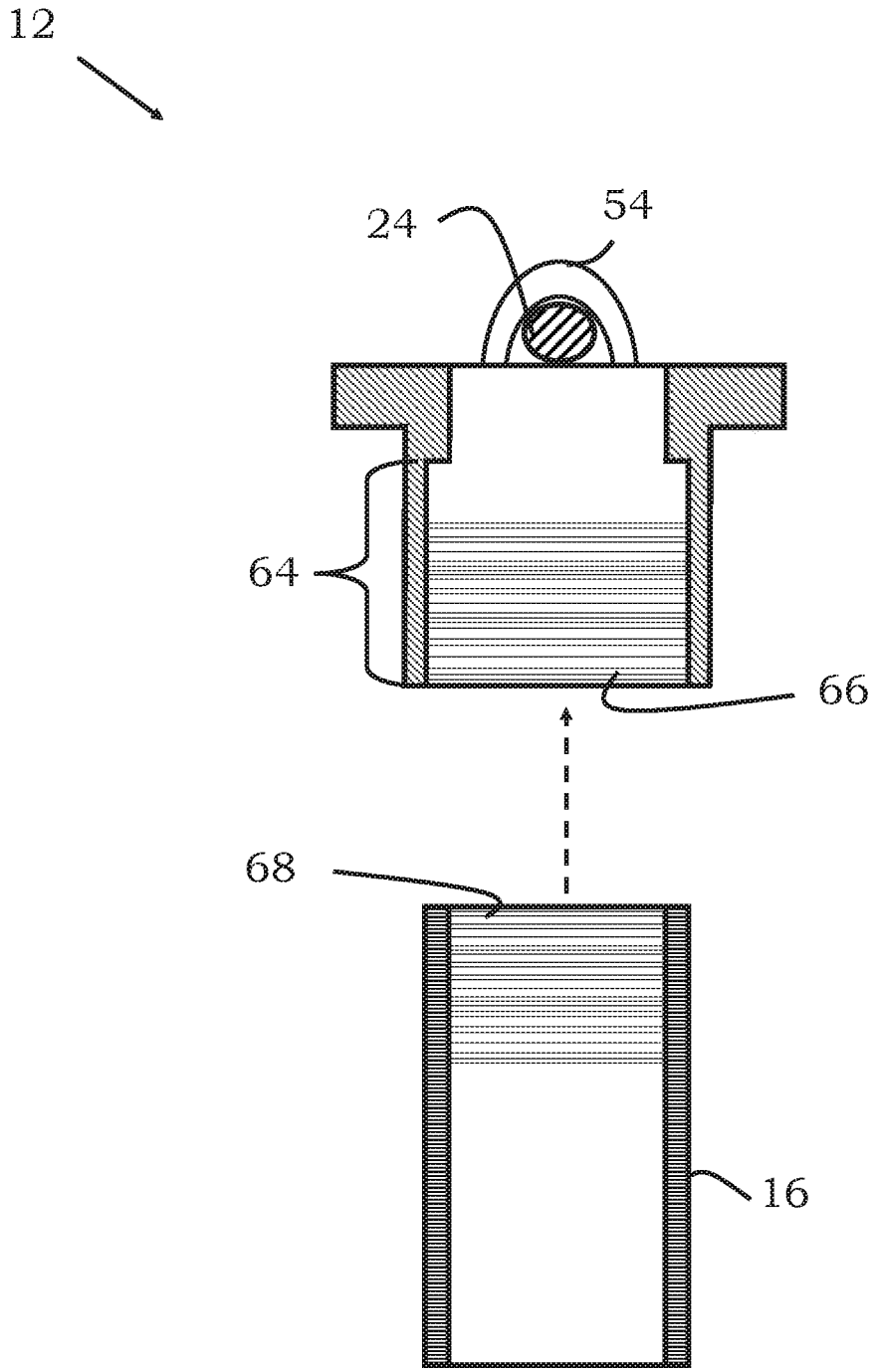
FIG. 4D depicts a cut-away view taken along line B-B in FIG. 4A depicting the rod spaced apart from the socket.

FIGS. 2 and 3 depict a plurality of tabs 36 disposed about a circumference of rod 16. Tabs 36 may be spaced apart from one another and arranged in a pattern about the circumference of rod 16 or may be arranged in a pattern. In embodiments in which rod 16 is not circular, the plurality of tabs 36 are disposed about a perimeter of rod 16. Each tab includes first tab end 38 formed integrally with rod body 30 and a terminal second tab end 40 spaced apart from rod body 30 forming channel between cavity 32 and an environment external to rod 16. Tabs 36 are angled and arranged such that when the underpinning device 10 is being driven into ground 18, dirt and other debris is prevented from entering cavity 32 and blocking pressurized fluid 44 from being extruded during the injection process. Channel 42 permits pressurized fluid 44, injected within cavity 32, to be extruded through channel 42 to the environment external to rod 16. Pressurized fluid 44 may be grout, cement, adhesive, molten metal, and/or other material known to anchor underpinning device 10 within ground 18.

Figure 5A:
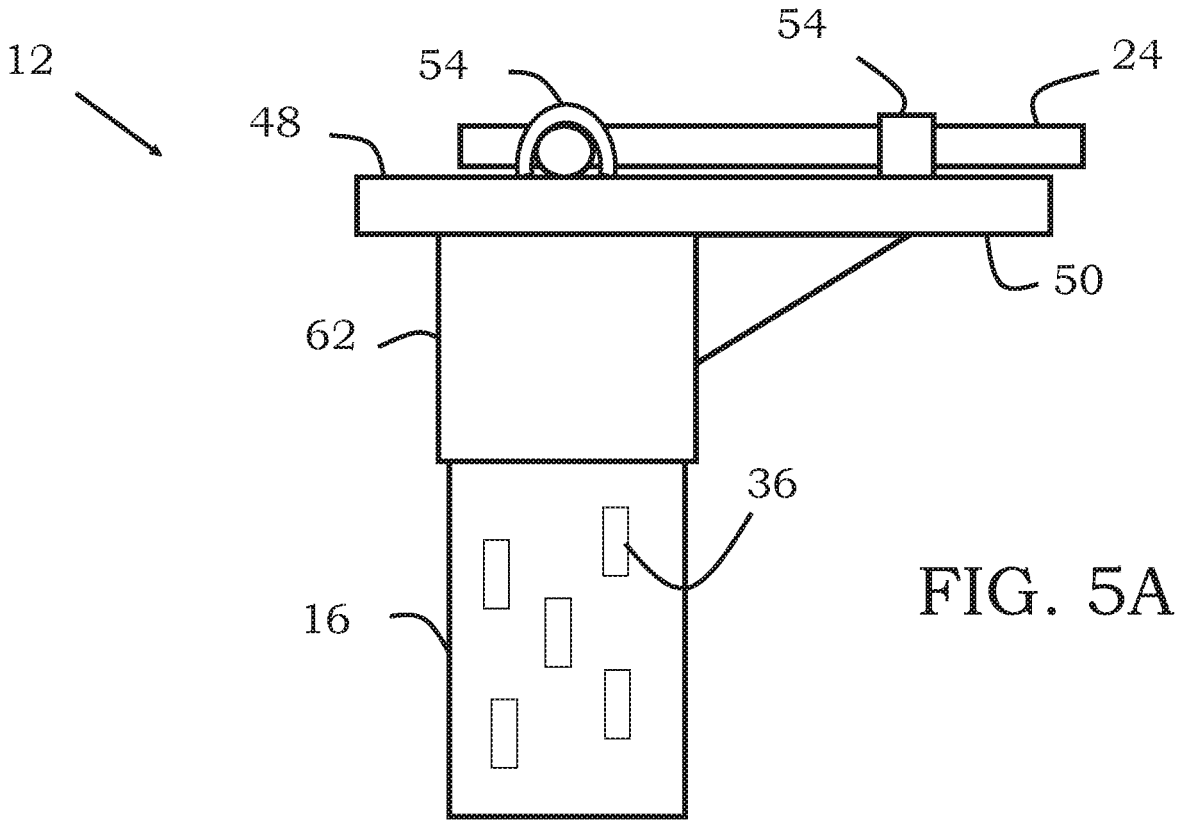
FIG. 5A depicts a side view of an embodiment of the underpinning support showing the first interacting element in the form of a corner piece secure to the rod.
Figure 5B:
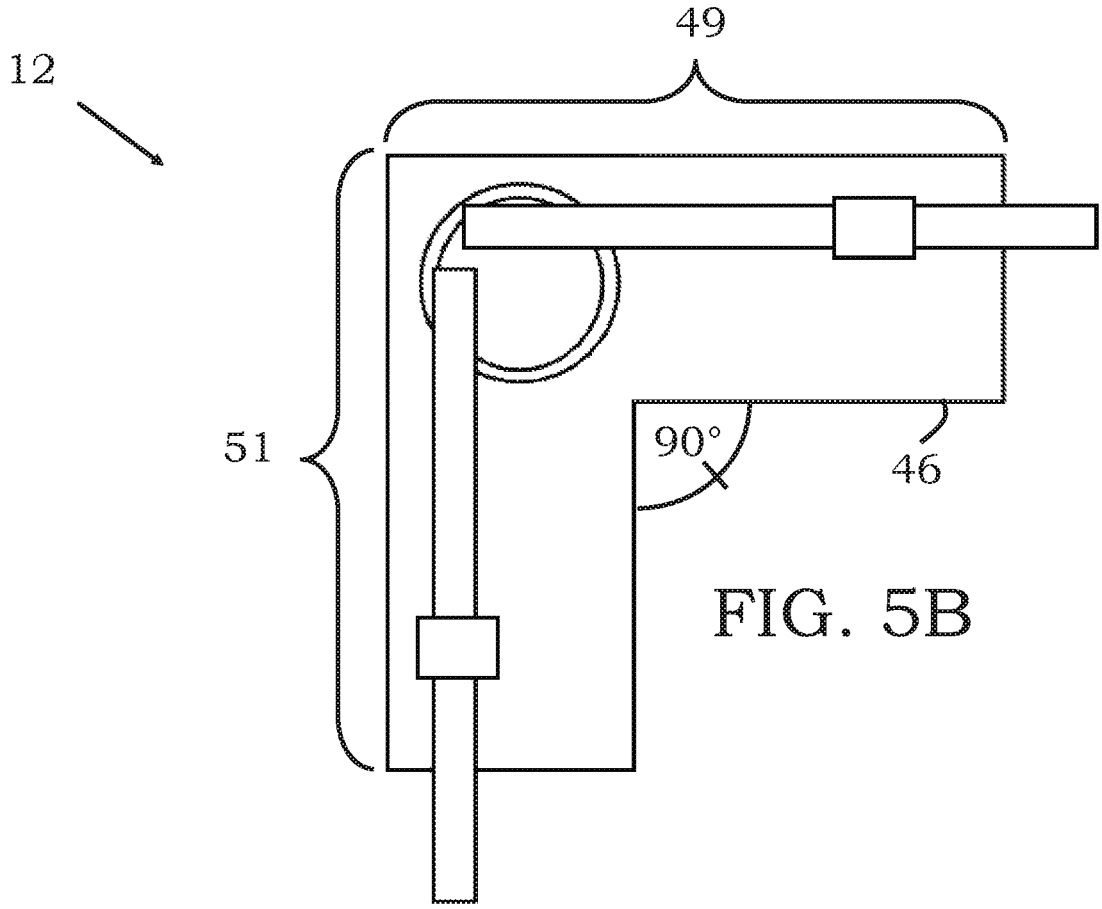
FIG. 5B depicts a top view of an embodiment of the underpinning support showing the first interacting element in the form of a corner piece.

As shown in FIGS. 4A-4D, first interacting element 12 includes platform 46 having first platform surface 48, second platform surface 50, and platform body 52 extending between each of the first 48 and second 50 platform surfaces. Platform 46 may include a variety of geometric shapes depending on the position of first interacting element 12 relative to structure 20 being supported. For example, when underpinning device 10 is positioned near the corner of structure 20, platform 46 may include first platform portion 49 and second platform portion 51 in an orthogonal relationship with one another forming a corner bracket as depicted in FIGS. 5A and 5B. In another embodiment, platform 46 may be square or rectangular in shape.

Extending away from first platform surface 48, alignment protrusion 54 receives link 24 disposed within alignment aperture 56. In an embodiment, one or more alignment protrusions 54 may extend away from first platform surface 48. Alignment aperture 56 is formed between first alignment aperture end 58 and second alignment aperture end 60. Alignment aperture 56 may be any shape that is capable of receiving links 24 when linking one or more underpinning devices 10 to one another. Link 24 may be rebar—such as European rebar, carbon steel rebar, epoxy-coated rebar, galvanized rebar, glass-fiber-reinforced-polymer (GFRP), stainless steel rebar, or similar material.

Extending away from second platform surface 50, first adapter 62 includes socket 64 formed within a portion of first adapter 62. Socket 64 is configured to receive proximal rod end 26 when first interacting element 12 is secured to proximal rod end 26. Socket 64 may include first set of threads 66 configured to threadedly engage with second set of threads 68 disposed on proximal rod end 26 to secure first interacting element 12 to rod 16. In an embodiment, first interacting element 12 is secured to rod 16 using a tang and locking strip mechanism, welding, adhesive, or any other method known in the art.

Depicted in FIGS. 6A-6D, second interacting element 14 includes second adapter 70 having first adapter end 72, second adapter end 74, and adapter body 76 encasing bore 78. Adapter body 76 extends from first adapter end 72 to second adapter end 74 with each adapter end 72, 74 defining an opening. Extending outwardly from at least a portion of outer adapter surface 80 of adapter body 76, blade 82 is configured to drill a hole within ground 18 upon rotation of rod 16 about central longitudinal axis 84 when second interacting element 14 is coupled to distal rod end 28. Blade 82 may extend from outer adapter surface 80 in an auger like configuration. Central longitudinal axis 84 extends through proximal rod end 26 and distal rod end 28. To facilitate the drilling of the hole within ground 18, blade 82 may include first blade portion 86 abutting or formed integrally with outer surface 80 of adapter body 76 and second blade portion 88 having a tapered end. Tapered end forms cutting edge 92 and aids in blade 82 being capable of drilling through ground 18. In an embodiment, cutting edge 92 may be angled away from blade body 90 of blade 82.

Removable tip 94 is configured to be at least partially disposed within bore 78 of second adapter 70 and secure therein using locking mechanism 100. Locking mechanism 100 includes flange 100*b* extending away from a portion of tip 94 and is configured to be removably secured within locking channel 100*a* of locking mechanism 100. Locking channel 100*a* is formed within interior wall 102 of adapter body 76. Engagement of flange 100*b* within locking channel 100*a* coupled tip 94 to second adapter 70 of second interacting element 14. Upon rotating second interacting element 14 about central longitudinal axis 84 in a first direction, flange 100*b* is transitioned within locking channel 100*a* from a first position to a second position, thereby securing tip 94 to second adapter 70. Consequently, rotating second interacting element 14 about central longitudinal axis 84 in a second direction, tip 94 is uncoupled from second adapter 70 as a result of flange 100*b* transitioning from a second position to a first position within locking channel 100*a*, thereby uncoupling tip 94 from second adapter end 70.

Figure 6A:
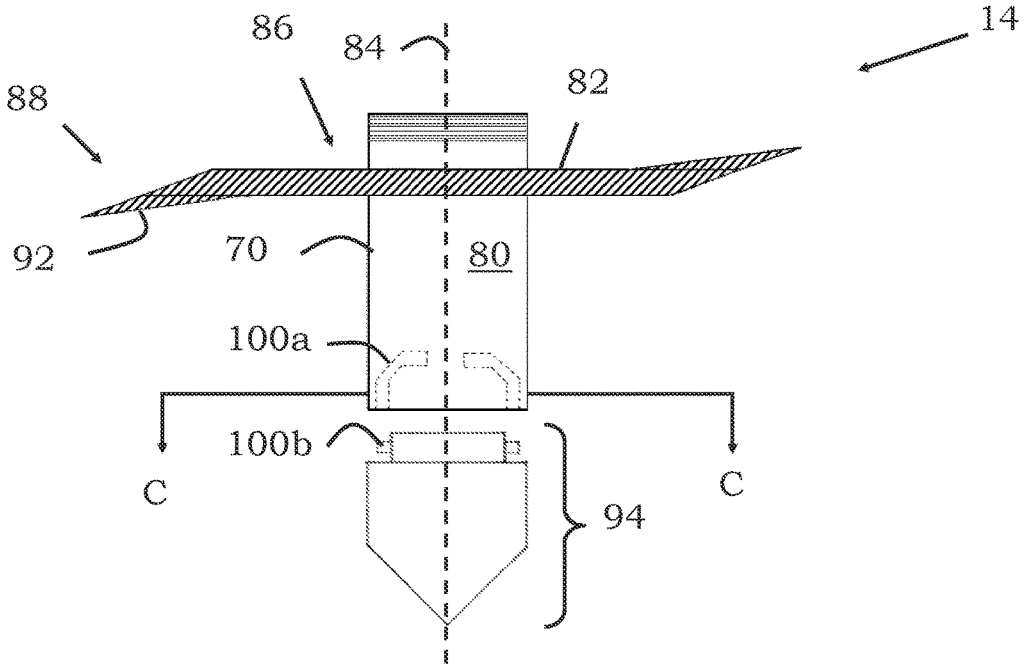
FIG. 6A depicts a side view of the second interacting element with the tip uncoupled from the second adapter.
Figure 6B:
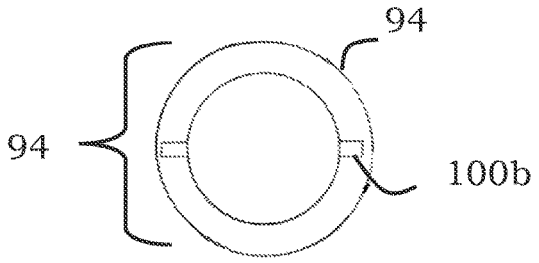
FIG. 6B depicts a top view of the tip of the second interacting element showing the flanges extending outwardly from a portion of the tip.
Figure 6C:
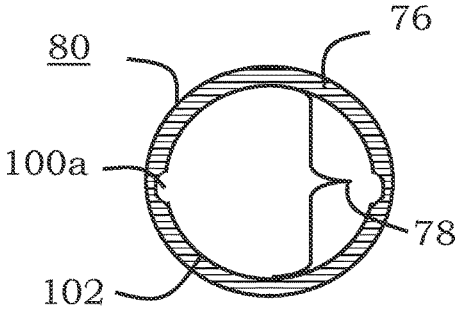
FIG. 6C depicts a cross-sectional view of the second adapter taken along line C-C of FIG. 6A.
Figure 6D:
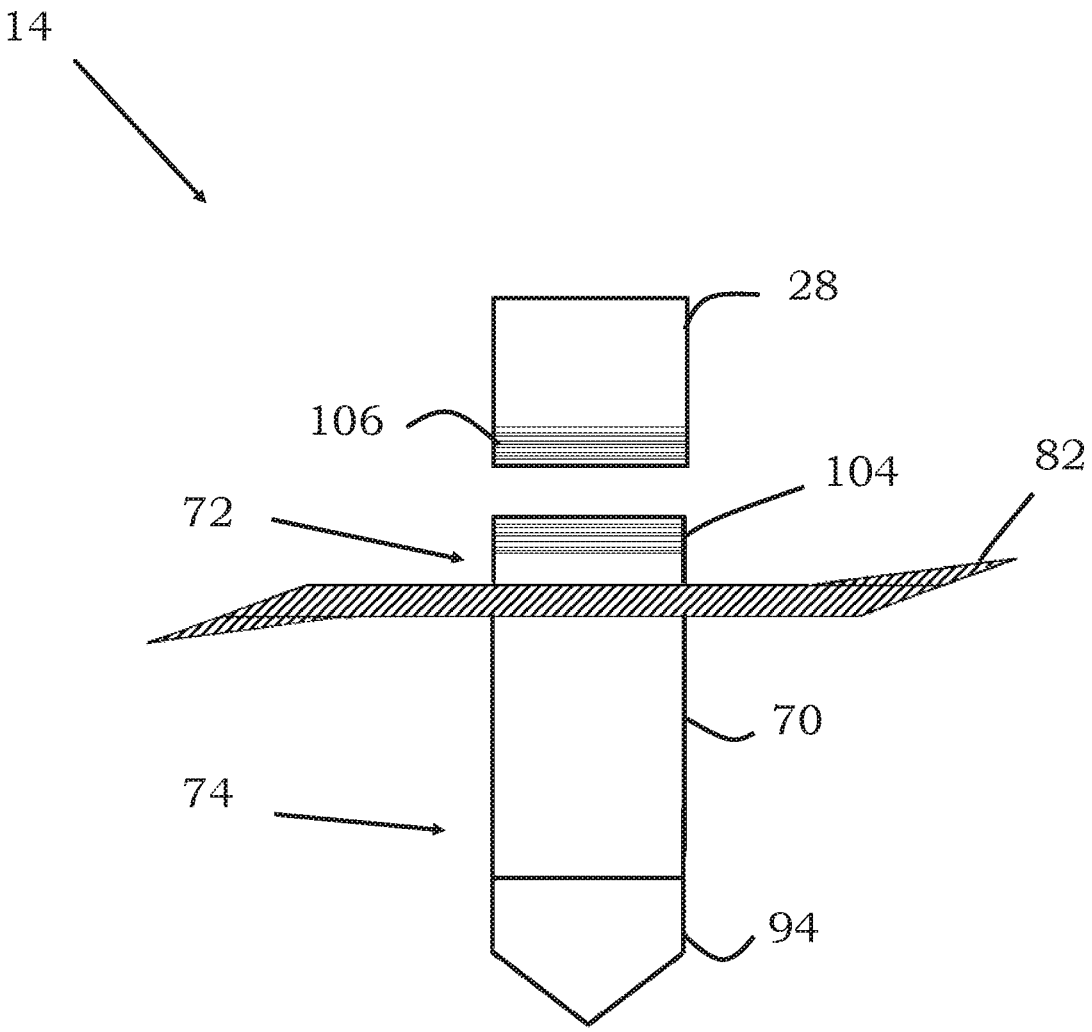
FIG. 6D depicts a side view of an embodiment of the second interacting element and the distal rod end.

As shown in FIG. 6D, first adapter end 72 includes third set of threads 104 configured to threadedly engage within fourth set of threads 106 of distal rod end 28. Engagement of third set of threads 104 with fourth set of threads 106, secures second interacting element 14 to distal rod end 26.

Figure 7A:
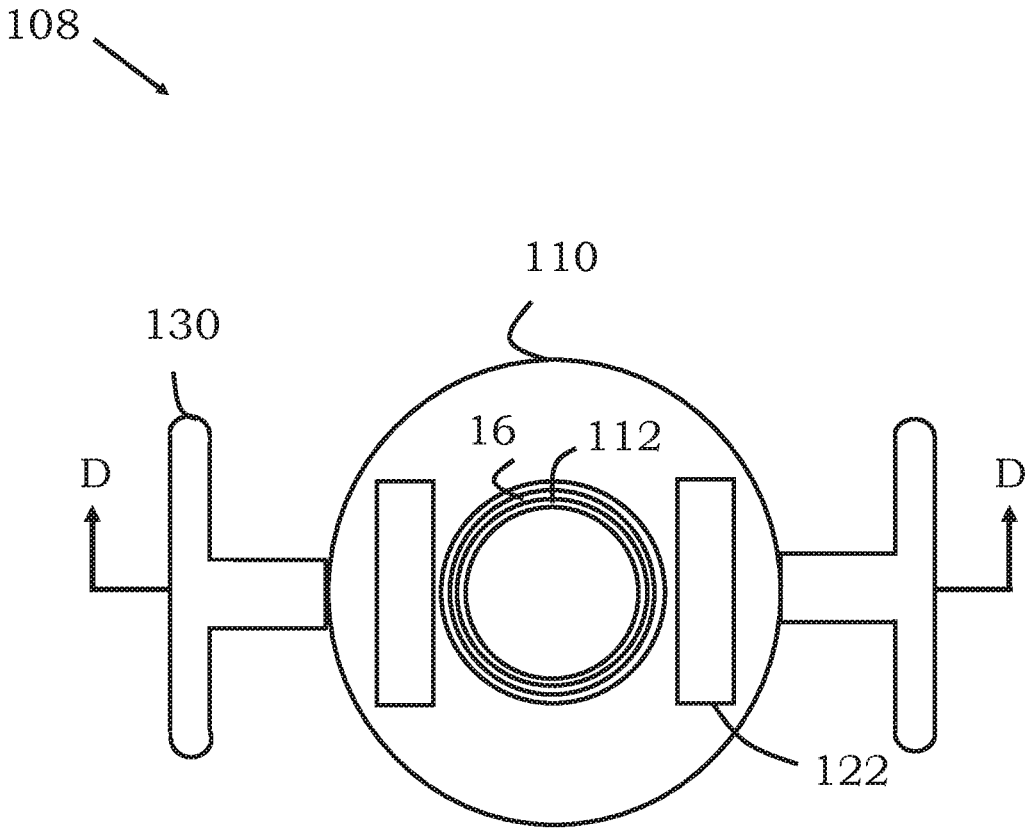
FIG. 7A depicts a top view of the injection adapter.
Figure 7B:
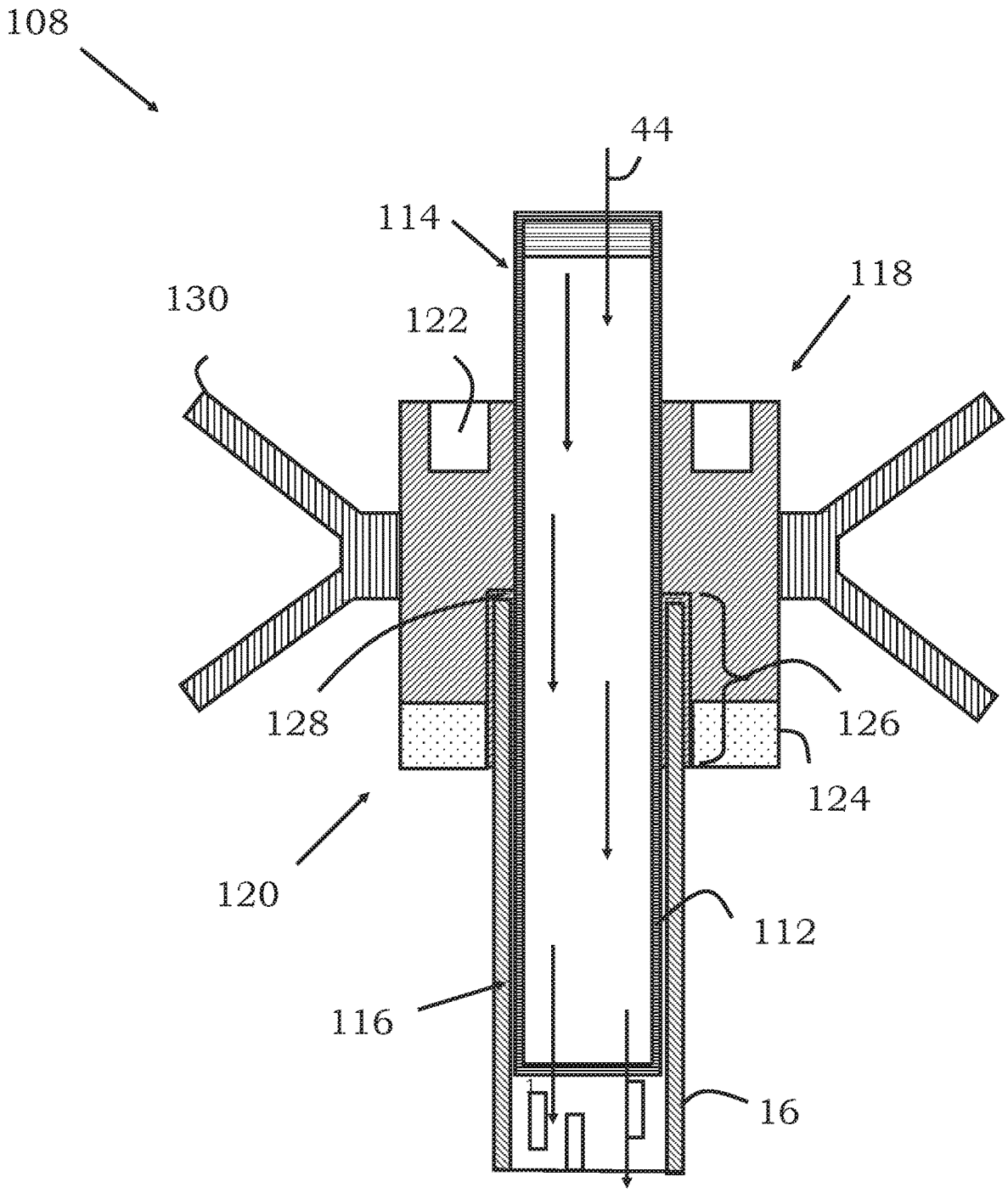
FIG. 7B depicts a cut-away view of the injection adapter of FIG. 7A taken along line D-D.

As shown in FIGS. 7A and 7B, injection adapter 108 includes injection body 110 and injection pipe 112 disposed through the center of injection body 110. Injection pipe 112 may be secured within or formed integrally with injection body 110. Injection pipe 112 include inlet 114 configured to couple to a source of pressurized fluid 44 and outlet 116 configured to resides within cavity 32 of rod 16. Injection pipe 112 is secured in place with respect to proximal rod end 26 by injection body 110. Injection body 110 includes first body end 118 and second body end 120.

First injection body end 118 houses power supply 122 and is configured to supply an amount of power to magnetic coils 124 disposed about the perimeter of the second injection body end 120. In an embodiment, power supply 122 may be batteries or may be electrical thermals coupled to an external power supply. Recess 126 is formed within injection body 110 and received proximal rod end 26 when outlet 116 is disposed within cavity 32. When injection adapter 108 is disposed over proximal rod end 26 and magnetic coils 124 are energized within an amount of power supplied from power supply 122, a magnetic field is generated which magnetically couples injection adapter 108 to proximal rod end 26. When the amount of power is withdrawn, the magnetic field dissipates, and injection adapter 108 is uncoupled from proximal rod end 26. Gasket 128 may be position within recess 126 and provides a seal between injection body 110 and proximal rod end 26 to provide an airtight seal and prevent the leaking of pressurized fluid 44 from the proximal rod end 26 during the injecting process. Handles 130 may be provided to facilitate the easy installation, removal, and transport of injection adapter 108.

Figure 8:
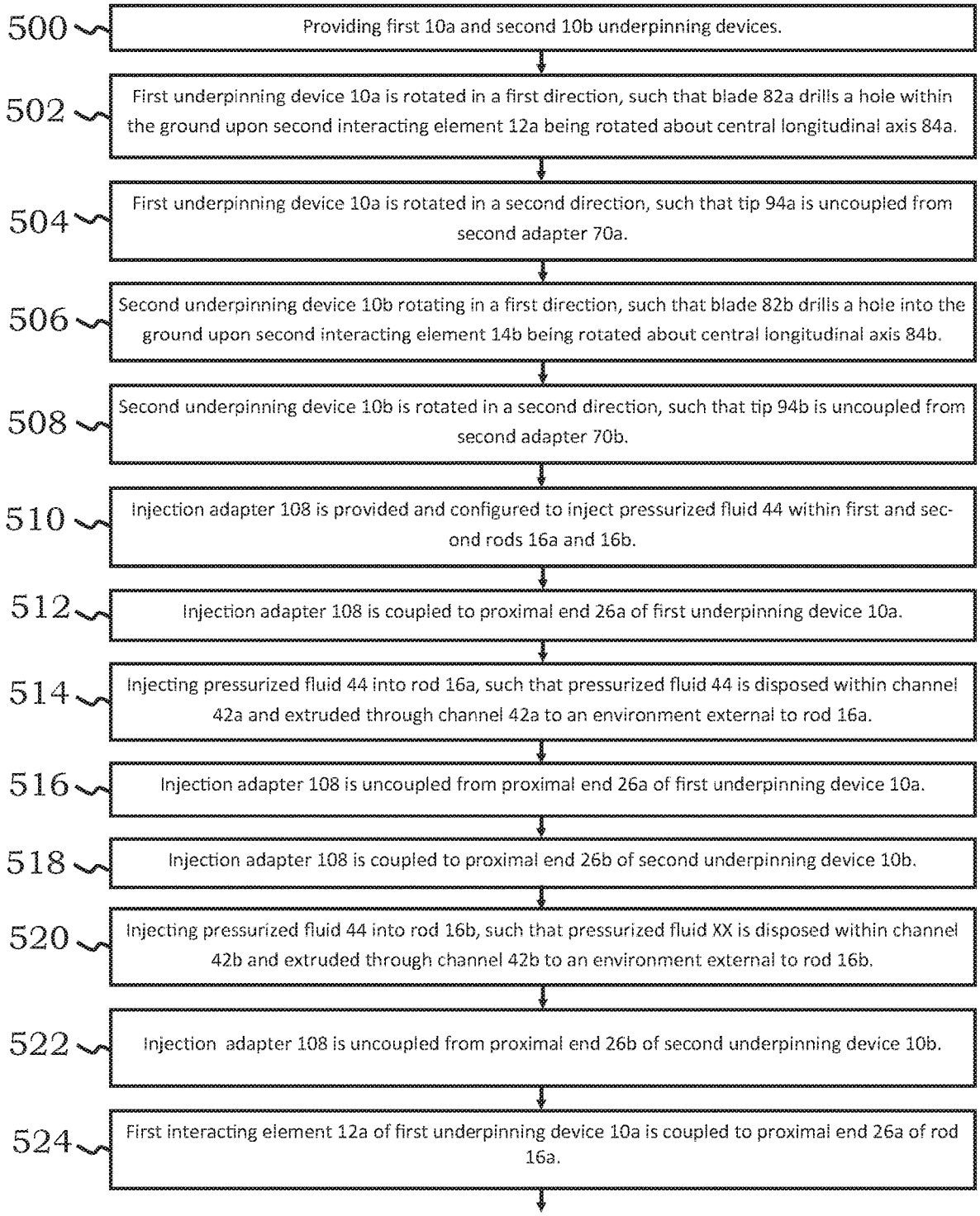
FIG. 8 depicts an exemplary process-flow diagram of underpinning a structure using one or more underpinning devices.
Figure 8:
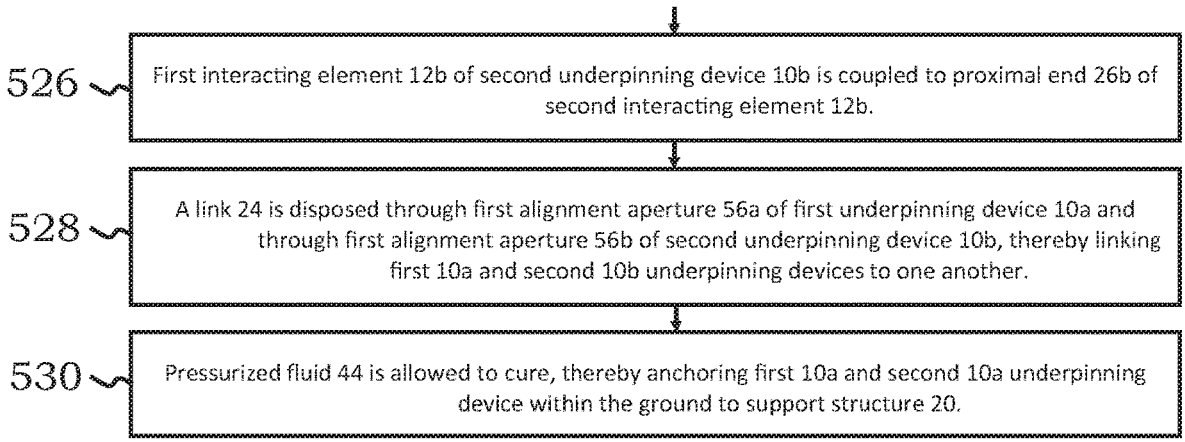

Referring now to FIG. 8, in conjunction with FIGS. 1-7, an exemplary process-flow diagram is provided, depicting a method for underpinning a structure using one or more underpinning devices. The steps delineated in the exemplary process-flow diagram of FIG. 8 are merely exemplary of a preferred order for the supporting a structure. The steps may be carried out in another order, or with or without additional steps included therein. Additionally, the steps may be carried out with an alternative embodiment of underpinning device 10, as contemplated in the description above.

The method for underpinning a structure using one or more underpinning devices begins at step 500, during which first 10*a* and second 10*b* underpinning device are provided. Underpinning devices 10*a* and 10*b* includes the components discussed above. The method then proceeds to step 502, in which first underpinning device 10*a* is rotated in a first direction, such that blade 82*a* drills a hole into ground 18 upon second interacting element 14*a* being rotated about central longitudinal axis 84*a*. In step 504, first underpinning device 10*a* is rotated in a second direction, such that tip 94*a* is uncoupled from second adapter 14*a*. Step 506 details second underpinning device 10*b* rotating in a first direction, such that blade 82*b* drills a hole into ground 18 upon second interacting element 14*b* being rotated about central longitudinal axis 84*b*. In step 508, second underpinning device 10*b* is rotated in a second direction, such that tip 94*b* is uncoupled from second adapter 70*b*.

In step 510, injection adapter 108 is provided and configured to inject pressurized fluid 44 within rod 16. In step 512, injection adapter 108 is coupled to proximal rod end 26*a* of first underpinning device 10*a*. Step 514 details injecting pressurized fluid 44 into rod 16*a*, such that pressurized fluid 44 is disposed within channel 42*a* and extruded through channel 42*a* to an environment external to rod 16*a*. In step 516, injection adapter 108 is uncoupled from proximal end 26*a* of first underpinning device 10*a*.

The method then proceeds to step 518, in which injection adapter 108 is coupled to proximal rod end 26*b* of second underpinning device 10*b*. Step 520 details injecting pressurized fluid 44 into rod 16*b*, such that pressurized fluid 44 is disposed within channel 42*b* and extruded through channel 42*b* to an environment external to rod 16*b*. In step 522, injection adapter 108 is uncoupled from proximal rod end 26*b* of second underpinning device 10*b*.

In step 524, first interacting element 12*a* of first underpinning device 10*a* is coupled to proximal rod end 26*a*. In step 526, first interacting element 12*b* of second underpinning device 10*b* is coupled to proximal rod end 26*b* of second interacting element 12*b*. The method then proceeds to step 528, in which a portion of link 24 is disposed through first alignment aperture 56*a* of first underpinning device 10*a* and through first alignment aperture 56*b* of second underpinning device 10*b*, thereby linking first 10*a* and second 10*b* underpinning devices to one another. Finally, in step 530, pressurized fluid 44 is allowed to cure, thereby anchoring first 10*a* and second 10*b* underpinning device within ground 18 to support structure 20.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An underpinning system for supporting a structure comprising:

an underpinning device configured to be secured to a link residing within a foundation of the structure prior to pouring cement around the link to create the foundation, the underpinning device including:

a rod having a proximal rod end, a distal rod end, and a rod body encasing a cavity, the rod body extending from the proximal rod end to the distal rod end and having a length sufficient to extend though the foundation of a structure and into a ground below the foundation;

a plurality channels formed between the cavity and an environment exterior to the rod, wherein at least some of the plurality of channels are longitudinally offset from each other about a longitudinal axis of the rod;

a first interacting element coupled to the proximal rod end, the first interacting element including:

a platform having a lateral span greater than a diameter of the rod, a first platform surface, a second platform surface, and a platform body extending between the first and the second platform surfaces, the first platform surface including:

a first alignment protrusion extending away from the first platform surface and configured to receive the link within an alignment aperture formed between a first alignment end and a second alignment end of the first alignment protrusion;

a second alignment protrusion extending away from the first platform surface and configured to receive the link within an alignment aperture formed between a first alignment end and a second alignment end of the second alignment protrusion;

the second alignment protrusion aligned with the first alignment protrusion such that alignment apertures in the first and alignment protrusions are axially aligned to receive the link;

wherein the first alignment protrusion is laterally spaced from the second alignment protrusion;

a first adapter extending away from the second platform surface, the first adapter including a socket formed within a portion of the first adapter and configured to receive the proximal rod end, thereby coupling the first interacting element to the proximal rod end;

a second interacting element coupled to the distal rod end, the second interacting element including:

a second adapter having a first adapter end, a second adapter end, and an adapter body encasing a bore, the adapter body extending from the first adapter end to the second adapter end;

a blade extending outwardly from at least a portion of an outer surface of the adapter body, wherein the blade is configured to drill a hole into the ground upon the rod rotating about a central longitudinal axis extending through the proximal rod end and the distal rod end;

an open fluidic channel extending through the first interacting element and into the cavity in the rod, thereby providing a path for a fluidic anchoring material to enter the first interacting element and exit the plurality of channels in the rod to deliver the fluidic anchoring material in the ground below the foundation, wherein the first alignment protrusion and the second alignment protrusion are laterally spaced out of axial alignment and on opposing lateral sides with respect to the open fluidic channel;

wherein the underpinning device is configured to reside both within the foundation and the ground to support the structure when secured within the ground.

2. The underpinning device of claim 1, further including:

a tip configured to be at least partially received within the bore of the second adapter when a locking mechanism is in a locked configuration, and when the locking mechanism is in an unlocked configuration, the tip is configured to be spaced apart from the second adapter; and wherein the locking mechanism further includes a flange extending away from a portion of the tip and a locking channel formed within the adapter body, such that when in the locked configuration the tip is disposed fully within the locking channel and when in the unlocked configuration the tip is disposed away from the locking channel.

3. The underpinning device of claim 1, wherein the cavity is configured to receive a pressurized fluid to anchor the underpinning device within the ground.

4. The underpinning device of claim 1, wherein the socket includes a first set of threads configured to threadedly engage with a second set of threads disposed at the proximal rod end, wherein engagement of the first set of threads with the second set of threads secures the first interacting element to the proximal rod end.

5. The underpinning device of claim 1, wherein the first adapter end includes a third set of threads configured to threadedly engage with a fourth set of threads disposed at the distal rod end, wherein engagement of the third set of threads with the fourth set of threads secures the second interacting element to the distal rod end.

6. The underpinning device of claim 1, wherein the link is a section of rebar.

7. The underpinning device of claim 1, wherein the platform is rectangular.

8. An underpinning device anchored within the ground for supporting a structure comprising:

a rod having a proximal rod end, a distal rod end and a rod body encasing a cavity, the rod body extending from the proximal rod end to the distal rod end, each of the proximal and distal rod ends defining a rod opening;

a plurality of tabs disposed about a perimeter of the rod, each tab including a first tab end formed integrally with the rod body and a terminal second tab end spaced apart from the rod body, such that a channel is formed between the cavity and an environment exterior to the rod;

a first interacting element coupled to the proximal rod end, the first interacting element including:

a platform having a first platform surface, a second platform surface, and a platform body extending between the first and the second platform surfaces, the first platform surface including an alignment protrusion extending away from the first platform surface and configured to receive a section of rebar within an alignment aperture formed between a first alignment end and a second alignment end of the alignment protrusion;

a first adapter extending away from the second platform surface, the first adapter including a socket formed within a portion of the first adapter and configured to receive the proximal rod end, thereby coupling the first interacting element to the proximal rod end;

a second interacting element coupled to the distal rod end, the second interacting element including:

a tip comprising a flange extending away from at least a portion of the tip, the tip configured to be at least partially received within a bore of a second adapter and secured therein by a locking mechanism;

the second adapter having a first adapter end, a second adapter end, and an adapter body encasing a second bore, the adapter body extending from the first adapter end to the second adapter end, each of the first and the second adapter ends defining an opening to the second bore, the second bore including a locking channel configured to receive the flange of the tip when the locking mechanism is in the locked configuration, when in the unlocked position, the flange is disposed away from the second adapter;

a blade extending outwardly from at least a portion of an outer surface of the adapter body, wherein the blade is configured to drill a hole into the ground upon the rod rotating about a central longitudinal axis extending through the proximal rod end and the distal rod end, and wherein the underpinning device is configured to support the structure when secured within the ground.

9. The underpinning device of claim 8, wherein the socket includes a first set of threads configured to threadedly engage with a second set of threads disposed at the proximal rod end, wherein engagement of the first set of threads with the second set of threads secures the first interacting element to the proximal rod end.

10. The underpinning device of claim 8, wherein the first adapter end includes a third set of threads configured to threadedly engage with a fourth set of threads disposed at the distal rod end, wherein engagement of the third set of threads with the fourth set of threads secures the second interacting element to the distal rod end.

11. The underpinning device of claim 8, wherein the blade further includes a first blade portion and a second blade portion, the first blade portion abutting the outer surface of the rod body of the second adapter and the second portion having a tapered end forming a cutting edge.

12. The underpinning device of claim 8, wherein the platform is rectangular in shape.

13. The underpinning device of claim 8, wherein the section of rebar forms a section of foundation of the structure.

14. The underpinning device of claim 1, wherein the alignment aperture in the first alignment protrusion and the alignment aperture in the second alignment protrusion are sized to be less than double a diameter of the rod intended to pass therethrough.

15. The underpinning device of claim 1, wherein the plurality of channels formed in the rod are preconfigured as open channels.

* * * * *